US008823523B2

(12) United States Patent
Lee et al.

(10) Patent No.: US 8,823,523 B2
(45) Date of Patent: Sep. 2, 2014

(54) REFRIGERATOR HAVING INPUT VOICE COMMANDS AND OUTPUT VOICE MESSAGES

(75) Inventors: Sung-Ae Lee, Changwon (KR); Min-Kyeong Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 400 days.

(21) Appl. No.: 12/673,127

(22) PCT Filed: Sep. 11, 2008

(86) PCT No.: PCT/KR2008/005388
§ 371 (c)(1),
(2), (4) Date: Feb. 11, 2010

(87) PCT Pub. No.: WO2009/035281
PCT Pub. Date: Mar. 19, 2009

(65) Prior Publication Data

US 2011/0210822 A1 Sep. 1, 2011

(30) Foreign Application Priority Data

Sep. 13, 2007 (KR) ..... 10-2007-0092936
Sep. 13, 2007 (KR) ..... 10-2007-0092937
Sep. 20, 2007 (KR) ..... 10-2007-0095678
Sep. 20, 2007 (KR) ..... 10-2007-0095679

(51) Int. Cl.
*G08B 13/14* (2006.01)

(52) U.S. Cl.
USPC ..... 340/572.1; 340/4.37; 340/4.4; 340/5.92; 340/540; 704/251; 704/258

(58) Field of Classification Search
CPC ..... G08C 17/02; G08C 23/04; G08C 19/28; G08C 2201/40; H04B 1/205; G11B 17/22; G07F 17/30; G07F 17/305; G04G 11/00; G04G 19/00; G06Q 10/087; G06Q 20/203; G06Q 10/06; G06Q 10/08; G06K 2017/0051; G06K 7/0008; G06K 19/0723; G06K 19/07749; G07C 9/00111; G08B 3/10; G08B 25/14; G08B 13/1672; G08B 21/12; G08B 25/10; G10L 15/22; G10L 15/265; G10L 15/08; G10L 15/063; G10L 13/07; G10L 13/043; G10L 13/06; G10L 13/04; H05K 999/99
USPC ..... 340/10.1, 4.37, 4.4, 540, 572.1, 5.92; 704/251, 258, E13.002, E15.005
See application file for complete search history.

(56) References Cited

U.S. PATENT DOCUMENTS

2003/0217160 A1* 11/2003 Gayama et al. ..... 709/228
2004/0100380 A1* 5/2004 Lindsay et al. ..... 340/540

(Continued)

FOREIGN PATENT DOCUMENTS

JP 2002-71259 A 3/2002
JP 2002-81849 A 3/2002

(Continued)

*Primary Examiner* — Omer S Khan
(74) *Attorney, Agent, or Firm* — Birch, Stewart, Kolasch, Birch, LLP

(57) ABSTRACT

A refrigerator is provided. The refrigerator includes a voice recognition unit for recognizing a voice of a name of food, a memory for storing location information of the food received in a storage chamber, a controller for determining the voice recognized by the voice recognition unit and searching a storage location of the food voice-recognized in accordance with the recognized voice, and a voice output unit for outputting a voice message on the storage location information of the food searched by the controller.

1 Claim, 9 Drawing Sheets

(56) References Cited

U.S. PATENT DOCUMENTS

| | | | | |
|---|---|---|---|---|
| 2004/0176906 | A1* | 9/2004 | Matsubara et al. | 701/200 |
| 2005/0258961 | A1* | 11/2005 | Kimball et al. | 340/572.1 |
| 2007/0191983 | A1* | 8/2007 | Griffits et al. | 700/213 |
| 2008/0047282 | A1* | 2/2008 | Bodin et al. | 62/129 |

FOREIGN PATENT DOCUMENTS

| | | | |
|---|---|---|---|
| JP | 2003-185326 | A | 7/2003 |
| JP | 2007-10208 | A | 1/2007 |
| KP | 10-2005-0110147 | A | 11/2005 |
| KR | 10-1999-0022498 | U | 7/1999 |
| KR | 10-2000-0014018 | U | 7/2000 |
| KR | 10-2001-0054983 | A | 7/2001 |
| KR | 10-2002-0006321 | | 1/2002 |
| KR | 2002-0047616 | A | 6/2002 |
| KR | 10-2003-0072807 | B1 | 9/2003 |
| KR | 10-2004-0021974 | A | 3/2004 |
| KR | 10-2004-0022102 | A | 3/2004 |
| KR | 10-2004-0064418 | A | 7/2004 |
| KR | 10-2004-083784 | A | 10/2004 |
| KR | 10-2004-0094453 | A | 11/2004 |
| KR | 10-2006-0119580 | A | 11/2006 |
| KR | 10-2006-0130899 | A | 12/2006 |

* cited by examiner

REFRIGERATOR HAVING INPUT VOICE COMMANDS AND OUTPUT VOICE MESSAGES

TECHNICAL FIELD

The present disclosure relates to a refrigerator.

BACKGROUND ART

Generally, a refrigerator is an electrical appliance for keeping food or other items cool.

The refrigerator typically includes a refrigerating compartment and a freezing compartment. The food is kept in the freezing compartment at a temperature below zero and in the refrigerating compartment at a temperature above zero.

However, according to the related art refrigerator, the user cannot identify the food kept in the refrigerator unless opening a refrigerator door. Therefore, the user opens the refrigerator door, finds food he/she wants, and takes the food cut of the refrigerator. This is troublesome for the user.

Further, in order to set or alter an operational mode of the refrigerator, the user presses or touches buttons provided on the refrigerator. This is also troublesome for the user.

In addition, a variety of buttons for many different functions are provided. However, there is no description for the buttons and thus it is difficult for the user to set and identify the functions. Accordingly, it frequently occurs that the user presses or touches wrong buttons.

DISCLOSURE OF INVENTION

Technical Problem

Embodiments provide a refrigerator that is designed to allow a user to easily identify locations of food stored therein.

Embodiments also provide a refrigerator that is designed to improve user convenience by allowing a user to set and identify functions thereof using his/her voice.

Technical Solution

In one embodiment, a refrigerator includes: a voice recognition unit for recognizing a voice of a name of food; a memory for storing location information of the food received in a storage chamber; a controller for determining the voice recognized by the voice recognition unit and searching a storage location of the food voice-recognized in accordance with the recognized voice; and a voice output unit for outputting a voice message on the storage location information of the food searched by the controller.

In another embodiment, a refrigerator includes: a voice recognition unit for recognizing a plurality of voice information required for selecting a specific function of the refrigerator; a memory for storing specific voice information, which will be displayed, among the plurality of the voice information recognized by the voice recognition unit; and a display portion for displaying letters corresponding to the specific voice information.

In still another embodiment, a refrigerator includes: a memory for storing a series of a plurality of steps of voice information related to a specific function of the refrigerator; a voice output unit for outputting the voice information related to the specific function step by step; and a controller for controlling the voice output unit.

Advantageous Effects

According to the embodiments, it becomes possible to easily find a location where desired food is located without opening a refrigerator door.

Further, since information input by user's voice is displayed on a display unit, the user can easily make a memo and arrange a schedule.

In addition, since steps for setting functions of the refrigerator are output by voices, the user can easily set and identify the functions of the refrigerator.

Furthermore, a plurality of functions are output by voices, the number of buttons can be remarkably reduced even if a variety of functions are added to the refrigerator.

MODE FOR THE INVENTION

Reference will now be made in detail to the embodiments of the present disclosure, examples of which are illustrated in the accompanying drawings.

Figure 1:
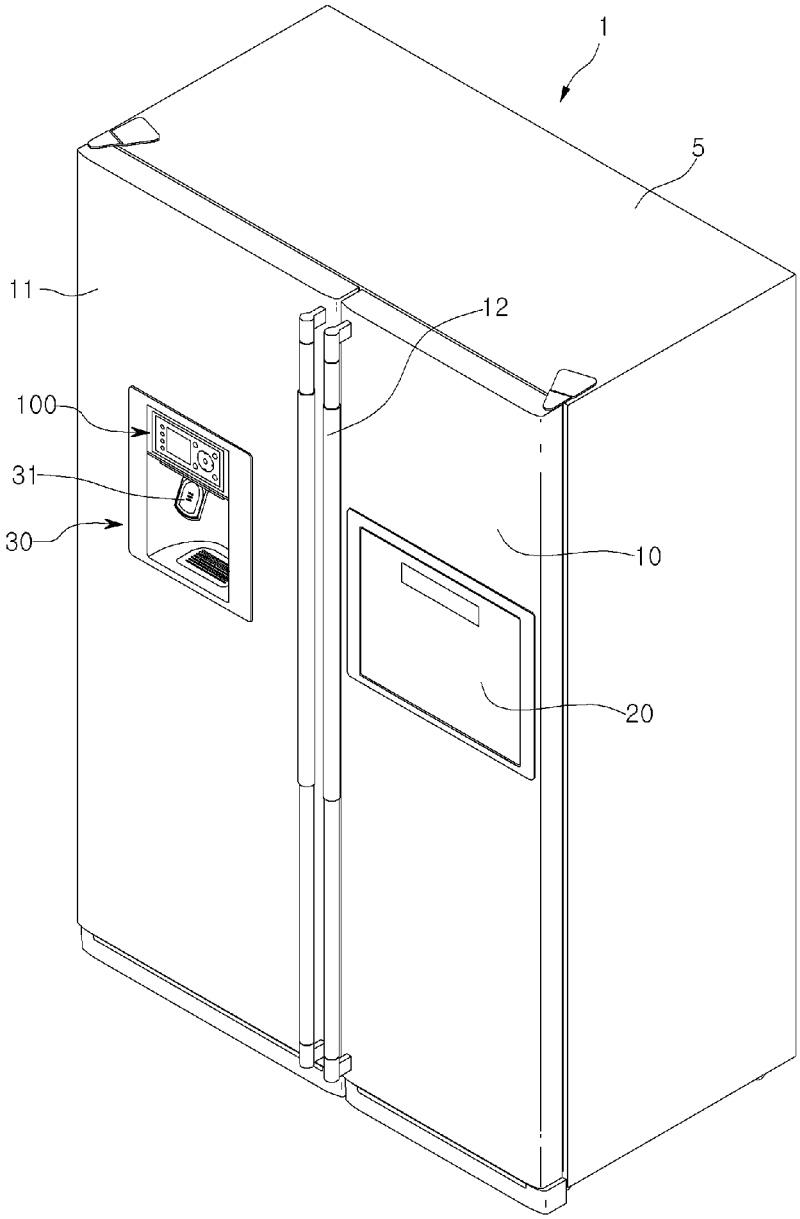
FIG. 1 is a front view of a refrigerator according to a first embodiment.

FIG. 1 is a front view of a refrigerator according to a first embodiment.

Referring to FIG. 1, a refrigerator 1 in accordance with an embodiment a main body 5 defining a storage chamber (not shown) and doors 10 and 11 for opening and closing the storage chamber. The doors 10 and 11 are pivotally coupled to the main body 5 by hinges. The doors 10 and 11 are provided with handles 12.

The storage chamber may be divided into freezing and refrigerating compartments that may be respectively opened and closed by the freezing and refrigerating doors 11 and 10.

In this embodiment, a left door in FIG. 1 will be referred to as the freezing door, and a right door will be referred to as a refrigerating door. However, these may be reversed.

The refrigerating door 10 is provided with a home bar 20. The home bar 20 is opened and closed by a home bar door. Beverages or cosmetics are stored in the home bar 20 at a lower temperature.

The freezing door 11 is provided with a dispenser 30. The dispenser 30 may be connected to a water tank (not shown) or/and an ice-making unit (not shown). A water supply unit (not shown) may be connected to the water tank and the ice-making unit.

A manipulation lever 31 is installed on the dispenser 30 to discharge water or ice. Alternatively, a discharging button (not shown) is provided on the dispenser 30 to automatically dispense the water or ice.

A display unit 100 is provided at an upper portion of the dispenser 30. The display unit 100 may be detachably installed at the upper portion of the dispenser 30. The display unit 100 may displays information on an operational state of the refrigerator and locations of food stuffs stored in the storage chamber and information on the food stuffs.

Figure 2:
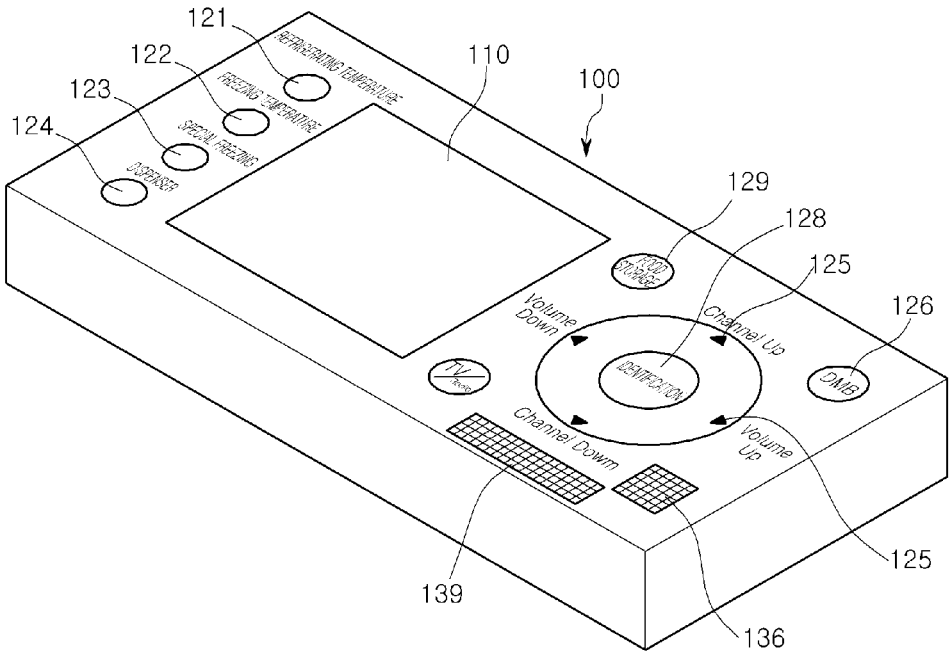
FIG. 2 is a perspective view of a display unit according to a first embodiment.

FIG. 2 is a perspective view of the display unit according to a first embodiment.

Referring to FIG. 2, the display unit 100 has a display portion for displaying an image.

The display portion 110 may be a liquid crystal display (LCD) or a plasma display panel (PDP).

An input unit is disposed at both sides of the display portion 110. For example, the input unit includes a button 121 for setting a refrigerating temperature, a button 122 for setting a freezing temperature, a button 123 for selecting a special freezing function, and a button 124 for selecting a function of the dispenser 30. The input unit further includes a button for adjusting a volume and channel of the display portion 110, a button 126 for selecting a digital multimedia broadcasting function, an identification button 128, and a button for selecting food to be stored.

Further, a voice input unit 136 for receiving user's voice is disposed at a side of the display portion 110. A microphone may be used as the voice input unit 136.

In addition, a voice output unit 139 is formed at a side of the display portion 110 to output a voice regarding locations of the food stuffs stored or/and storage periods of the food stuffs. A speaker may be used as the voice output unit 139.

Figure 3:
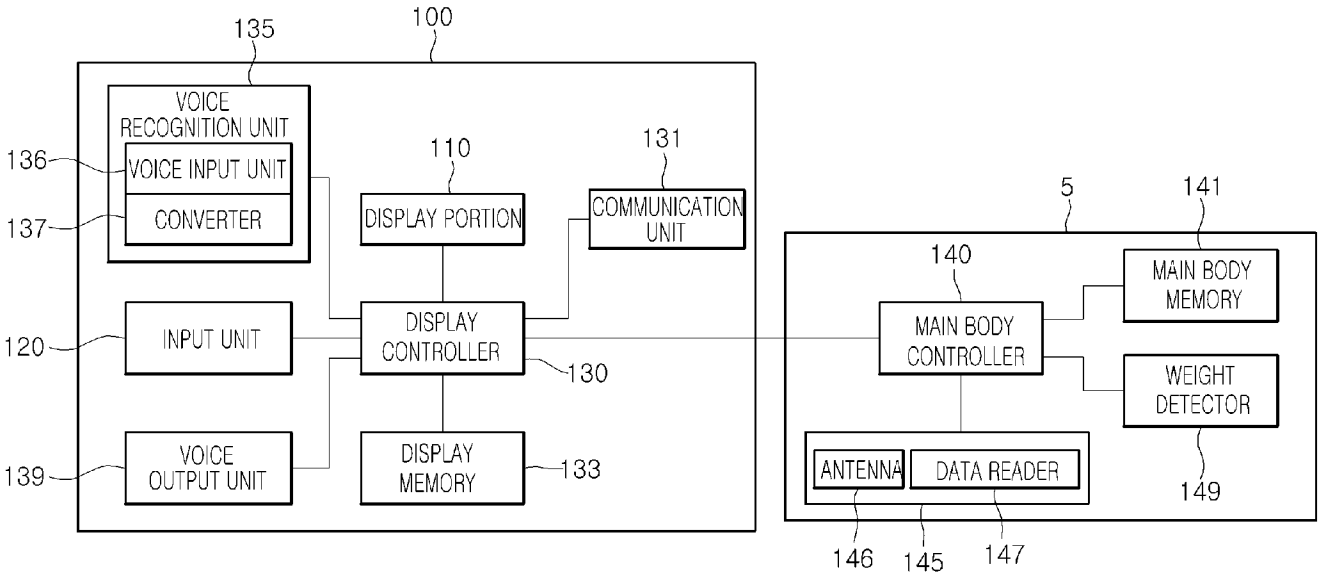
FIG. 3 is a block diagram of a refrigerator and a display unit according to a first embodiment.

FIG. 3 is a block diagram of the refrigerator and the display unit.

Referring to FIG. 3, the display unit 100 in accordance with the embodiment includes a display controller 130, a display portion 110, a communication unit 131, an input unit 120, a display memory 133, a voice recognition unit 135, and a voice output unit 139.

In more detail, the communication unit 131 receives image data or digital multimedia broadcasting data from a broadcasting station or a base station and outputs the received data through the display portion 110 or/and the voice output unit 139.

The voice recognition unit 135 includes a voice input unit 136 for inputting user's voice and a converter 137 for converting the voice input from the voice input unit 136 into a voice frequency. The converter 137 converts the voice frequency into a digital signal and transfers the digital signal to the display controller 130. The display controller 130 stores the digital signal in the display memory 133.

The display memory 133 pre-stores therein voice information that corresponds to names of the food stuffs stored in the refrigerator and will be output through the voice output unit 139. The voice information related to the names of the food stuffs is pre-stored in the display memory unit 133 during the manufacture of the refrigerator.

The display controller 130 is connected to a main body controller 140. A main body memory 141 and a radio frequency (RF) reader 145 are connected to the main body controller 140. Data on the functions of the refrigerator are pre-stored in the main body memory unit 141.

The RF reader 145 includes a plurality of antennas 146 for transmitting and receiving information on the RF tags attached on the food containers and high frequency signals and a data reader 147 for processing the information received through the antennas 146.

Here, the storage chamber may be divided into a plurality of receiving chambers by, for example, shelves. The antennas 146 may be provided in the respective receiving chambers. Therefore, the antennas 146 transmit and receive signals to and from the respective RF tags received in the respective receiving chambers. At this point, the antenna 146 is spaced apart from the corresponding RF tag by a transmittable/receivable distance.

The antennas 146 are designed to transmit and receive the signals to and from the respective RF tags within different frequency bands.

For example, the first antenna is designed to transmit and receive the signals to and from the corresponding RF tag within a range of 10-20 khz, the second antennas is within a range of 20-30 khs, and the third antennal is within a range of 30-40 kHz. At this point, the ranges of the frequency band for the transceiver with the RF tags include a frequency band of all of the antennas.

The main body memory 141 stores information on the antennas 146 corresponding to locations of the respective receiving chambers.

In this case, when the RF tag is received in a specific receiving chamber, the antenna disposed in the specific receiving chamber receives the information on the RF tag and the main body controller 140 determines an installing location of the antenna related to the RF tag. Therefore, the information of the location of the food stuffs that are newly received can be accurately identified.

For example, when a specific antenna having a frequency band of 10-20 kHz receives the information of the RF tag, the main body controller 140 identifies the location of the receiving chamber corresponding to the specific antenna received in the main body memory 141.

In addition, a plurality of weight detectors 149 for detecting weight variations of the shelves when the food stuffs are received in or withdrawn from the storage chamber of the refrigerator are provided. Each of the weight detectors 149 is installed on an undersurface of each storage chamber or a top surface of each of the shelves. The weight detector 149 detects the weight variation when the food is received in or withdrawn from the storage chamber and transmits the detected variation to the main body controller 140. Then, the main body controller 140 can detect which food is received in or withdrawn from which storage chamber.

Further, the main body memory 141 stores therein information of the respective weight detectors 149 corresponding to the respective receiving chambers.

Therefore, according to the embodiment, the locations where the food stuffs are stored can be accurately identified by the antennas 146 and the weight detectors 149 that are provided in the respective receiving chambers.

The main body controller 140 transfers information on the names and locations of the food stuffs stored. At this point, the display controller 130 stores the information in the display memory 133.

Meanwhile, when the user intends to load the food in the refrigerator, he/she pushes a food storage button 129 (see FIG. 2), inputs the name of the food through the voice recognition unit 135, selects the location of the storing location through the input unit, and loads the food in the corresponding storage chamber. Then, the name and location of the food are stored in the display controller 133. As described above, the user can manually input the names and locations of the food stuffs by himself/herself. This manual input method can be applied when no electronic tag is attached on a package or container of the food stuff.

That is, in this embodiment, the names and locations of the food stuffs can be stored in the main body memory (or a display memory) using one of automatic and manual input methods. The following will describe a case where the names and locations of the food stuffs are input by the manual input method.

Figure 4:
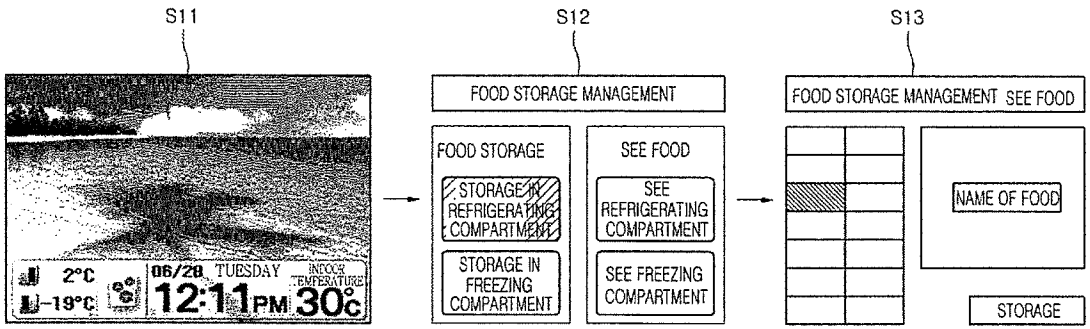
FIG. 4 is a block diagram illustrating a process for inputting food information on a refrigerator according to a first embodiment.

FIG. 4 is a block diagram illustrating a process for inputting food information in the refrigerator according to a first embodiment.

Referring to FIG. 4, when no voice is recognized by the voice recognition unit 135, the information on the operation state of the refrigerator is displayed on the display unit as a main screen (S11).

When the user pushes the food storage button 129, the display unit 110 displays a food storage management screen (S11). A refrigerating compartment storage, freezing compartment storage, refrigerating compartment view, and freezing compartment view buttons are displayed on the food storage management screen (S12). For example, in a state where the refrigerating compartment storage button is selected, the food name is input through the voice input unit 136. The converter 137 converts the voice frequency related to the food name into a digital signal and transfers the converted signal to the display controller 130. At this point, the display portion 110 may display the food storage location and food name (S13).

When the user selects the storage location and presses the storage button, the display controller 130 stores the information on the food storage location and the digital signal on the name of the food in the display memory 133.

Here, the food storage location may be detected by the weight detector 149.

That is, the main controller 140 transfers the information on the storage chamber whose weight is detected to the display controller 130.

Further, the display controller 130 compares the storage location that is manually input with the storage chamber whose weight variation is detected and corrects the storage location to the storage chamber whose weight variation is detected. Therefore, it can be prevented that the food is stored in a wrong location.

Figure 5:
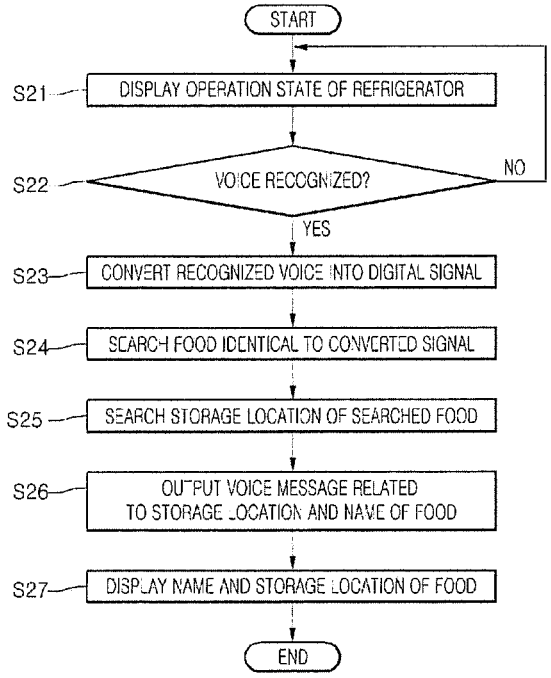
FIG. 5 is a flowchart illustrating a method for identifying and displaying locations of food stored in a refrigerator according to a first embodiment.

FIG. 5 is a flowchart illustrating a method for identifying and displaying locations of food stored in a refrigerator according to a first embodiment.

Referring to FIG. 5, the display unit 110 displays the information on the operation state of the refrigerator (S21).

When the user inputs a name of the food using his/her voice through the voice input unit 136 (S22), the converter 137 converts the recognized voice into the digital signal (S23).

At this point, the display controller 130 searches information on the food pre-stored in the display memory 133, which is identical to the converted digital signal (S24).

Further, the display controller 133 searches the storage location of the food, which corresponds to the digital signal (S25). As described above, the food storage location is pre-stored in the display memory 133 by the manual or automatic method.

When the food name and the storage location are searched, the display controller 130 controls the voice output unit 139 such that the food name and storage location are output by the voice (S26). In addition, the display portion 110 displays the name and location of the food (S27).

At this point, the voice output unit 139 outputs the storage period of the food by the voice.

In the above description, the location of the food stored in the refrigerator is automatically identified by the voice or image on the display portion). However, it is also possible for the user to manually identify the location of the food.

Accordingly, the user can easily identify the food stored in the refrigerator without opening the refrigerator door.

In this embodiment, the refrigerator additionally provides a variety functions in addition to the food location identification function. The following will describe the variety of the functions.

Figure 6:
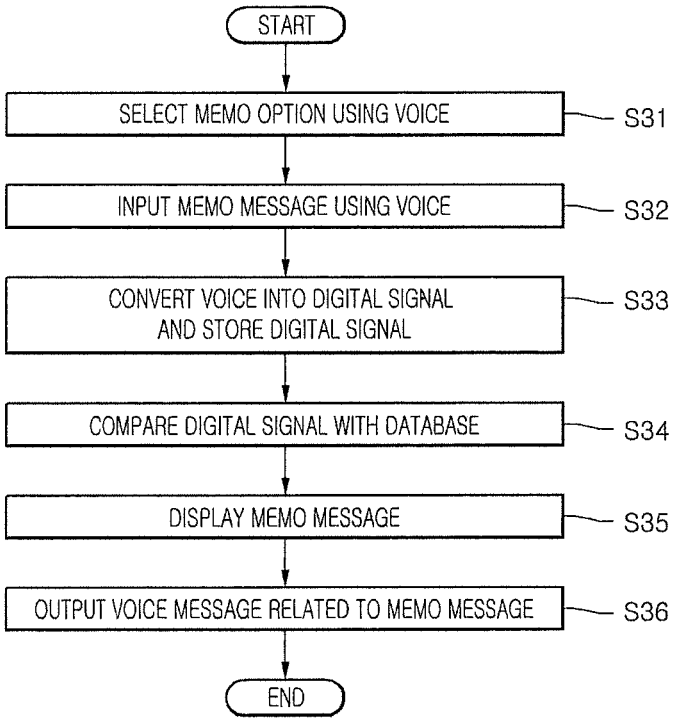
FIG. 6 is a flowchart illustrating a voice recognition memo function of a refrigerator according to a first embodiment.

FIG. 6 is a flowchart illustrating a voice recognition memo function of a refrigerator according to a first embodiment.

Referring to FIG. 6, a memo option is selected by inputting a voice 'memo' the voice input unit 136. At this point, the display control unit 130 compares a voice signal regarding the memo with a database to determine that the memo option is selected.

As the same time, the display controller 130 displays a memo screen on the display portion 110.

Next, the voice output unit 139 output a message 'please input a memo.' At this point, when the user determines that there is no need to input the memo, the memo says 'undo memo.' Then, the display controller 130 cancels the memo option.

On the other hand, in order to input the memo, the user inputs desired memo message using his/her message (S12). For example, the user inputs a memo message 'Mother goes cut for the exercise.' At this point, when the user wishes to change the memo message, the user inputs a message 'memo change' using his/her voice. Then, the memo message that is previously input is deleted. In addition, the user can input a change memo message using his/her voice.

Then, the converter 137 converts the voice signal into the digital signal and transfers the digital signal to the controller 130. The display controller 130 stores the digital signal corresponding to the memo message 'mother goes out for the exercise' in the display memory 133. In addition, the display controller 130 compares the signals stored in the database and determines that the digital signal is identical to the message 'mother goes out for the exercise' (S14).

At this point, the display controller 130 outputs a voice message 'do you want to display your memo message?' thrash the voice output unit 139. When the user say 'yes,' the display controller 130 displays the memo message 'mother goes out for the exercise' and the memo input time on the display portion 133 (S15). Subsequently, the voice output unit 139 outputs the input memo message by the voice (S16). Therefore, the user can determine if the input message is correct.

At this point, when the user wishes to delete the memo message that is being displayed, he/she inputs a voice command 'delete the memo message.' Then, the memo message stored in the display memory 133 is deleted and the display portion 130 displays the main screen (see FIG. 3).

Figure 7:
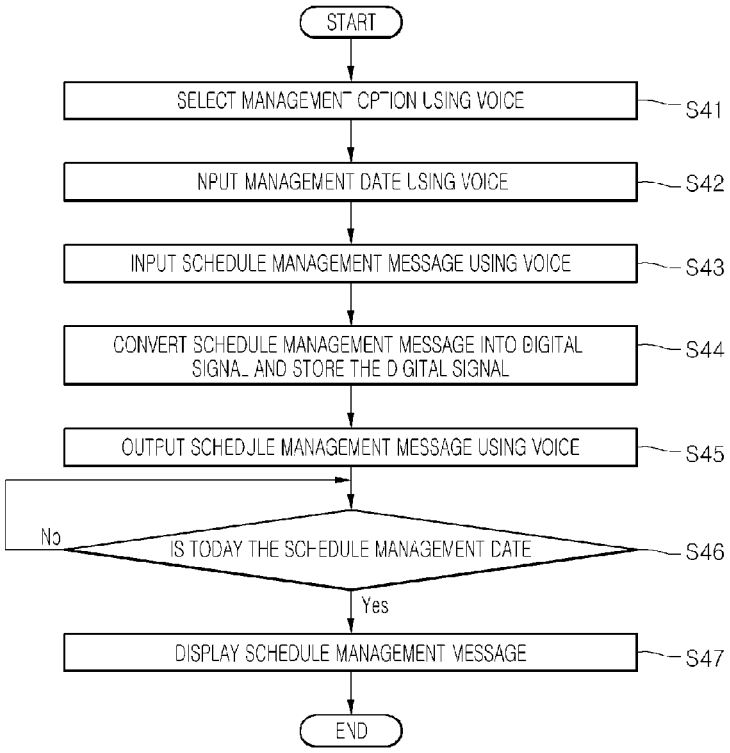
FIG. 7 is a flowchart illustrating a voice schedule management function of a refrigerator according to an embodiment.

FIG. 7 is a flowchart illustrating a voice schedule management function of a refrigerator according to a first embodiment.

Referring to FIG. 7, when a voice command 'schedule management' is input using the voice input unit 136, a schedule management option is selected (S41). At this point, the display controller 130 compares the voice signal related to the memo message with the data base to determine that the schedule management option is selected.

At the same time, the display controller 130 displays a schedule management screen on the display portion 110.

Here, when it is determined that there is no need to manage the schedule, the user inputs a voice command 'undo the schedule management.' Then, the display controller 130 cancels the schedule management option.

Next, the voice output unit 139 outputs a voice command 'input a schedule management date.' Then, the user inputs a voice massage on the schedule management date (e.g., December 5) through the voice input unit 136.

Next, the voice output unit 139 outputs a voice command 'input a schedule management message.' At this point, the user inputs a voice memo message (S43). For example, the user inputs a memo message 'Mother's birthday.' At this point, when the user wishes to change the schedule management message, he/she inputs a voice command 'schedule management change.' Then, the schedule management message that is previously input is deleted. Subsequently, the user can input a new schedule management message using his/her voice.

The converter 137 converts the voice signal into the digital signal and transfers the digital signal to the display controller 130. The display controller 130 stores digital signals corresponding to 'December 5' and 'Mother's birthday' in the display memory 133 (S44). In addition, the display controller 130 compares the signals stored in the database to determine that the digital signals are respectively identical to the 'December 5' and 'Mother's birthday.'

At this point, when the user intends to delete the schedule management message, the user inputs a voice command 'delete the schedule management message.' Then, the schedule management message stored in the display memory 133 is deleted.

Next, the display controller 130 controls such that the voice output unit 139 outputs the schedule management message by a voice (S25) so that the user can identify if the schedule management message is correct without seeing the display portion 110.

Further, the display controller 130 determines if today corresponds to the schedule management date input by the user (S26). When it is determined that today corresponds to the schedule management date input by the user, the display portion 110 displays the schedule management message (S27).

When the user wishes to delete the schedule management message that is being displayed, the user inputs a voice command 'delete the schedule management message.' Then, the memo message stored in the display memory 133 is deleted and the display portion 110 displays the main screen (see FIG. 3).

Figure 8:
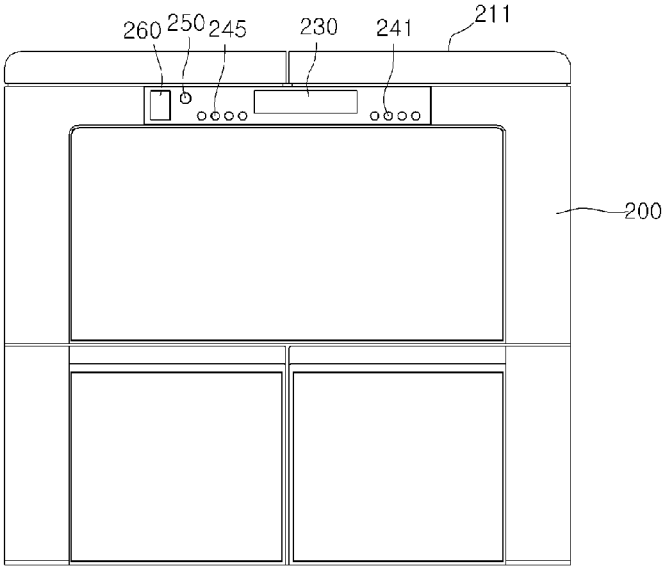
FIG. 8 is a front view of a refrigerator according to a second embodiment.

FIG. 8 is a front view of a refrigerator according to a second embodiment.

In this embodiment, the refrigerator shown in FIG. 8 is a Kimchi refrigerator.

Referring to FIG. 8, a refrigerator of this embodiment has a main body 200 in which a plurality of storage chambers (not shown) are defined. For example, left upper/lower storage chambers and right upper/lower storage chambers may be formed in the main body 200. Doors 210 are installed on a top of the main body 200 to open and close the storage chambers.

A display portion 230 is disposed on a front-upper portion of the main body 200. An LCD and PDP may be used as the display portion 230.

An input unit 240 is disposed at both sides of the display portion 230. The input unit 240 includes a plurality of selection buttons 241, an identification button 245, and a use glide button 250. The use wide button 250 is a button selected by the user to operate a voice output unit 160 that will be described later.

A voice output unit 260 for outputting a voice is provided at a side of the display portion 230. For example, a speaker may be used as the voice output unit 260.

Figure 9:
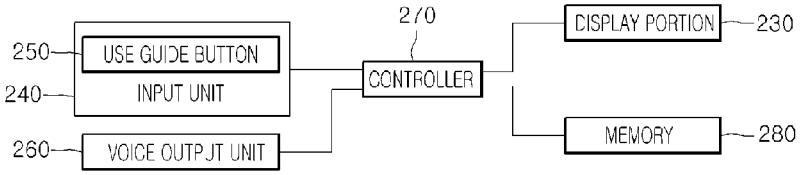
FIG. 9 is a block diagram of a refrigerator according to a second embodiment.

FIG. 9 is a block diagram of a refrigerator according to a second embodiment.

Referring to FIG. 9, the refrigerator includes a controller 270, a display portion 230, an input unit 240, a memory 280, and a voice output unit 260.

The input unit 240 may be a button or touch screen.

The memory 280 pre-stores storage temperatures and control information for a taste keeping function, Kimchi storage function, vegetable/fruit storage function, refrigerating function, and the like. For example, voice information such as 'this is a taste keeping function,' 'this is Kimchi storage function,' and the like is pre-stored.

The memory 280 further pre-stores voice signals of a series of steps for the use guide.

For example, the user guide for the taste keeping function is formed of a series of voice signals such as a first step voice signal 'this is a taste keeping function,' a second step voice signal 'select a storage chamber that will be used,' a third step voice signal 'a storage chamber is selected,' a fourth step voice signal 'select one of high, medium, and low cooling modes,' a fifth step voice signal 'the food will be stored in the selected refrigerating chamber with the selected cooling mode,' a sixth step voice signal 'do you want to store the taste keeping function?' and a seventh step voice signal 'the taste keeping function is stored.' the user guide for the Kimchi storage function is formed of a series of voice signals such as a first step voice signal 'this is a Kimchi storage function,' a second step voice signal 'select a storage chamber that will be used,' a third step voice signal 'a storage chamber is selected,' a fourth step voice signal 'select one of high, medium, and low cooling modes,' a fifth step voice signal 'the food will be in the selected refrigerating chamber with the selected cooling mode,' a sixth step voice signal 'do you want to store the Kimchi storage function?' and a seventh step voice signal 'the Kimchi storage function is stored.'

In addition, when the user pushes the identification button 245 in a state where the voice is output, a next step voice signal is output through the voice output unit 260. At this point, when the user pushes the identification button 245 whenever the voice is output, the series of the steps can be set.

The display portion 230 can display the information for the series of the steps in accordance with the user guide.

Figure 10:
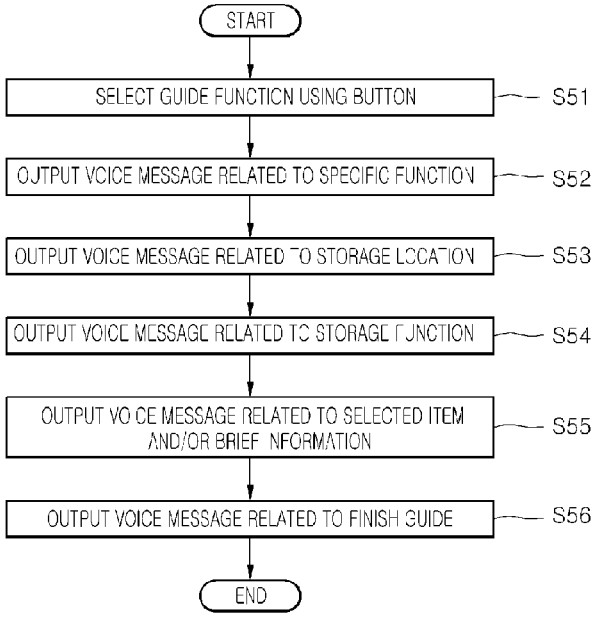
FIG. 10 is a flowchart illustrating a method of controlling a refrigerator according to a second embodiment.

FIG. 10 is a flowchart illustrating a method of controlling a refrigerator according to a second embodiment.

Referring to FIG. 10, the user guide button 250 is selected and a specific function is selected (S51). Then, the controller 270 transfers a voice signal on the specific function to the voice output unit 260. For example, when the Kimchi storage function is selected after the user guide button 250 is selected, the voice output unit 260 outputs the voice signal on the Kimchi storage function (S52). That is, the voice output unit 260 outputs a voice message 'this is the Kimchi storage function.'

Next, when the identification button 245 is selected, the controller 270 provides a voice signal on a storage chamber location of a next step to the voice output unit 260. Then, the voice output unit 260 outputs the voice signal on the storage chamber location (S53). For example, the voice output unit 260 outputs a voice message 'input a storage chamber that will be used.'

When the storage chamber location and the identification button 245 are selected, a voice message on the input storage chamber location is output from the voice output unit 260. For example, the voice output unit 260 outputs a voice message 'the left-upper storage chamber is designated.'

Next, when the identification button 245 is selected, the controller 270 provides a voice signal on a security function of a next step to the voice output unit 260. Then, the voice output unit 260 outputs a voice message 'select one of high, medium, and low cooling modes' (S54).

For example, when the storage function (high cooling mode) and the identification button 245 are selected, the controller 270 transfers voice information on the selected item of the nest step to the voice output unit 260. Then, the voice output unit 260 outputs a voice message 'Kimchi will be stored in the left-upper storage chamber with the high cooling mode' (S55). In addition, the controller 270 additionally transfers brief information on the Kimchi storage function to the voice output unit 260. For example, the brief information may be 'the Kimchi storage function is.' Therefore, the voice output unit 260 can output a voice message on the Kimchi storage location, storage temperature, and other brief information (S55).

Next, when the identification button 245 is selected, a voice signal related to a finish guide of the next step is output from the voice output unit 270 (S66). For example, the voice output unit 260 outputs a voice message 'the Kimchi storage function is stored. Thanks' and the use guide function is finished.

According to this embodiment, when the use guide function is selected, a series of function selections are output by voices step by step and thus the user can easily select a desired function in response to the voices output.

Figure 11:
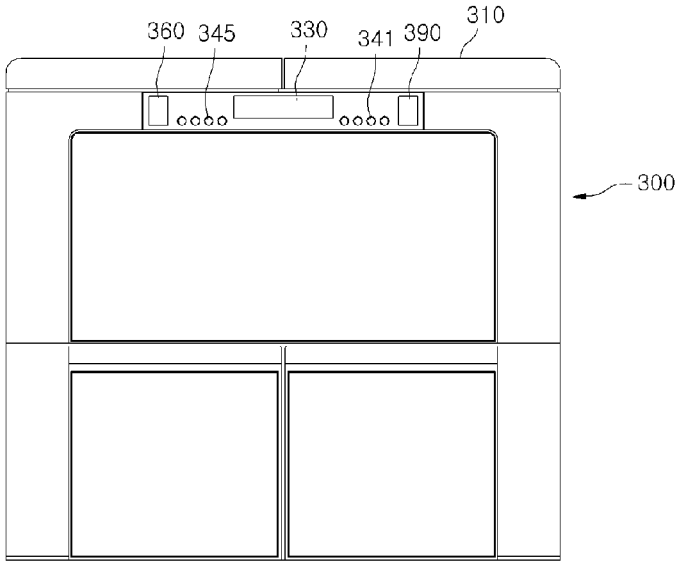
FIG. 11 is a front view of a refrigerator according to a third embodiment.

FIG. 11 is a front view of a refrigerator according to a third embodiment.

Referring to FIG. 11, a refrigerator of this embodiment has a main body 300 in which a plurality of storage chambers (not shown) are defined. Doors 310 are installed on a top of the main body 300 to open and close the storage chambers.

A display portion 330 is disposed on a front-upper portion of the main body 300. An input unit 340 is disposed at both sides of the display portion 330. The input unit 240 includes a plurality of selection buttons 241 and an identification button 245.

A voice recognition unit 390 is provided at a side of the display portion 330. In addition, a voice output unit 360 for outputting a voice is provided at another side of the display portion 330.

Figure 12:
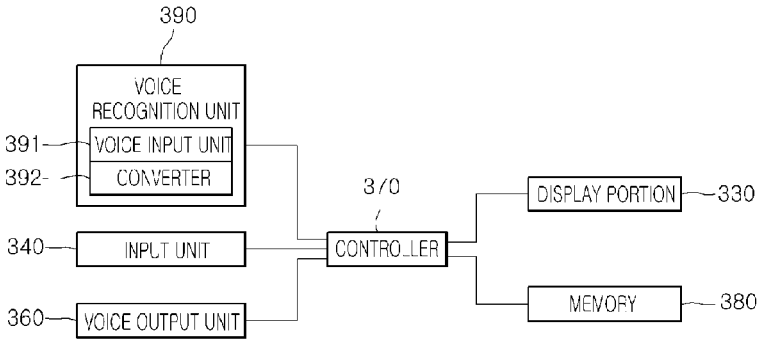
FIG. 12 is a block diagram of a refrigerator according to a third embodiment.

FIG. 12 is a block diagram of a refrigerator according to a third embodiment.

Referring to FIG. 12, the refrigerator of this embodiment includes a controller 370, a display unit 330, an input unit 340, a memory 380, a voice recognition unit 390, and a voice output unit 360, which are electrically connected.

The voice recognition unit 390 includes a voice input unit 391 for inputting user's voice and a converter 392 for converting the voice input from the voice input unit 391 into a voice frequency. The converter 392 converts the voice frequency into a digital signal and transfers the digital signal to the controller 370. The controller 370 stores the digital signal in the memory 380.

The memory 380 pre-stores storage temperatures and control information for a taste keeping function, Kimchi storage function, vegetable/fruit storage function, refrigerating function, and the like. For example, voice information such as 'this is a taste keeping function,' 'this is Kimchi storage function,' and the like is pre-stored.

The memory 380 further pre-stores voice signals of a series of steps for the use guide. The use guide function is substantially same as the second embodiment and thus the detailed description thereof will be omitted herein.

In this embodiment, when a voice message is input through the voice input unit 391, a voice signal of a next step is output from the voice output unit 360. At this point, when the user inputs a voice message whenever the voice signal is output, a series of functions can be set step by step.

That is, in the second embodiment, the next voice signal is output by selecting the identification button. However, in this embodiment, the next voice signal is output when the user voice message is input.

The display portion 330 can display information on the plurality of the steps in accordance with the user guide.

Figure 13:
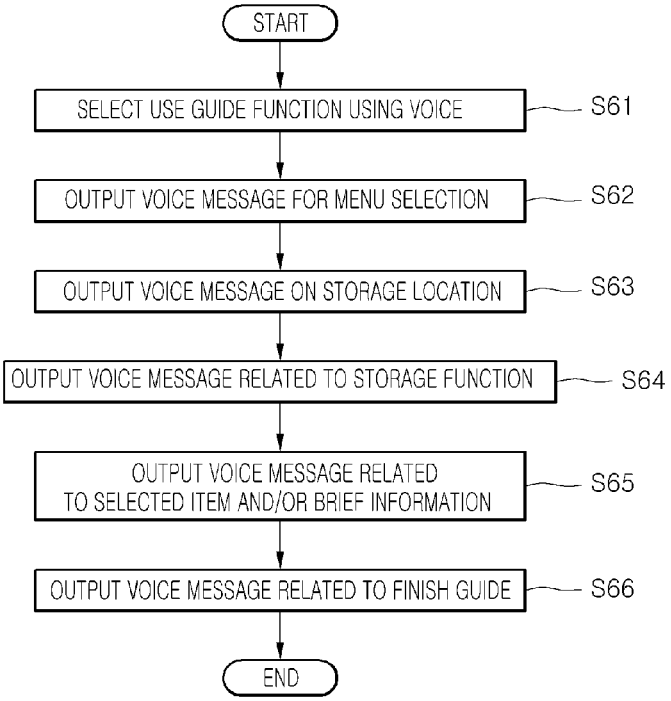
FIG. 13 is a flowchart illustrating a method of controlling a refrigerator according to a third embodiment.

FIG. 13 is a flowchart illustrating a method of controlling a refrigerator according to a third embodiment.

Referring to FIG. 13, the 'use guide function' is input by the voice through the voice input unit 391 (S61). Then, the voice output unit 360 outputs a voice message on the menu selection. For example, a voice message 'select a menu' is output from the voice output unit 360 (S62). At this point, the voice message such as 'select menu' output from the voice output unit may be referred to as 'related voice information' related to a specific Junction.

Next, a voice message related to a specific menu is input through the voice input unit 391. For example, when a voice message 'taste keeping function' is input, the controller 370 transfers a voice signal related to the taste keeping function to the voice output unit 360. At this point, the voice message 'taste keeping function' input from the voice input unit in response to the related voice information may be referred to as 'corresponding voice information.'

Then, the voice output unit 360 outputs a voice signal on a specific function. For example, the voice output unit 360 outputs a voice signal 'this is the taste keeping function.' At this point, the voice signal 'this is the taste keeping function' output from the voice output unit in response to the corresponding voice information input from the voice input unit 360 may be referred to as 'identification voice information.'

That is, in the present disclosure, the voice information output from the voice output unit in response to the specific function may be referred to as the related voice information, the voice information output from the voice recognition unit in response to the related voice information may be referred to as the corresponding voice information, and the voice information output from the voice output unit in response to the corresponding voice information may be referred to as the identification voice information.

Further, when an identification voice 'yes' is input through the voice input unit 391, the controller 370 transfers a voice signal on the storage chamber location of a next step to the voice output unit 360.

Then, the voice output unit 360 outputs the voice signal on the storage chamber location. For example, the voice output unit 360 outputs a voice message 'input a storage chamber that will be used.'

When the voice input unit 391 inputs a voice message 'right-lower storage chamber,' the voice output unit 360 outputs a voice signal related to the input storage chamber location. For example, the voice output unit 360 outputs a voice message 'right-lower storage chamber is designated.'

Further, when the voice message 'yes' is input through the voice input unit 391, the controller 370 transfers the voice signal related to the storage function of a next step to the voice output unit 360. Then, the voice output unit 360 outputs a voice message 'select one of high, medium, and low cooling modes' (S64).

When a voice message 'low cooling mode' is input through the voice input unit 391, the controller 370 transfers voice information related to a selected item of a next step to the voice output unit 360. Then, the voice output unit 360 outputs a voice message 'the food will be stored in the right-lower storage chamber with the low cooling mode' (S65). In addition, the controller 370 additionally transfers brief information on the taste keeping function to the voice output unit 360. For example, the brief information may be 'the taste keeping function is.'

Therefore, the voice output unit 360 can output a voice message on the Kimchi storage location, storage temperature, and other brief information (S65).

When a voice message 'storage' is input through the voice input unit 391, the voice output unit 360 outputs a voice signal on the finish guide of a next step (S66). For example, the voice output unit 360 may output a voice message 'the taste keeping function is stored. Thanks' and the use guide function is finished.

Figure 14:
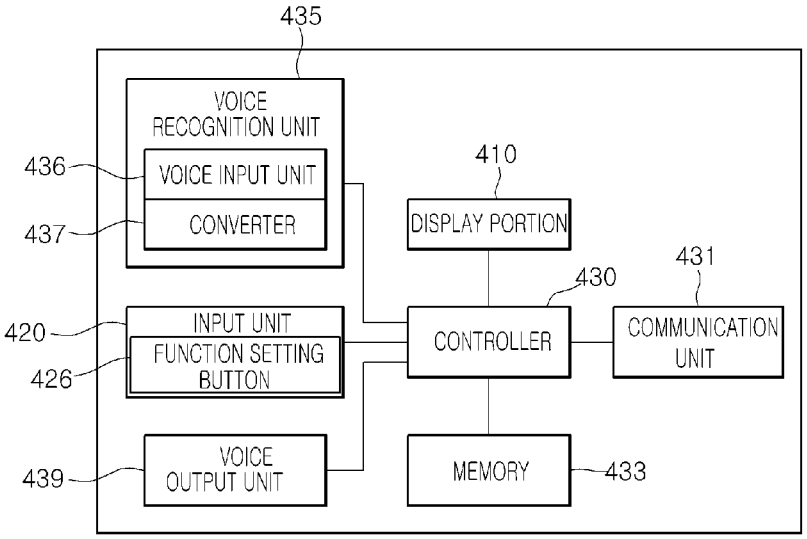
FIG. 14 is a block diagram of a refrigerator according to a fourth embodiment.

FIG. 14 is a block diagram of a refrigerator according to a fourth embodiment.

Referring to FIG. 14, the refrigerator of this embodiment includes a controller 430, a display unit 410, a communication unit 431, an input unit 420, a memory 433, a voice recognition unit 435, and a voice output unit 439.

The controller 430 generally controls the operation of the refrigerator.

The communication unit 431 receives image data or digital multimedia broadcasting data from a broadcasting station or a base station and outputs the received data through the display portion 410 or/and the voice output unit 439.

The voice recognition unit 435 includes a voice input unit 436 for inputting user's voice and a converter 437 for converting the voice input from the voice input unit 436 into a voice frequency. The converter 437 converts the voice frequency into a digital signal and transfers the digital signal to the controller 430. The controller 430 stores the digital signal in the memory 433.

The input unit 420 includes a function setting button 426 for setting a function of the refrigerator. At this point, the function setting button 426 may be Braille for the blind persons. The function setting button 426 is selected by the user to operate the voice output unit.

The memory 380 pre-stores a variety of voice signals for setting the function of the refrigerator. For example, the pre-stored voice signals may include 'this is for setting and identifying the function of the refrigerator,' 'select one of a temperature adjustment, special freezing, dispenser, and additional functions,' 'the function setting will be stopped if you say 'stop the function setting', 'a desired function is selected,' 'select finish if you wants to finish,' 'function setting is completed.' Such voice signals are output voice signals for noting the user through the voice output unit 439.

The memory 380 further pre-stores voice signals so as to read and extract the voice input by the user through the voice input unit 436. For example, the voice signals include 'function setting,' 'special freezing,' 'dispenser,' '점 additional function,' 'stop,' 'identification,' 'completion,' and the like. Such voice signals are voice signals for determining which function is selected by the user when the user input a voice through the voice input unit 436.

Figure 15:
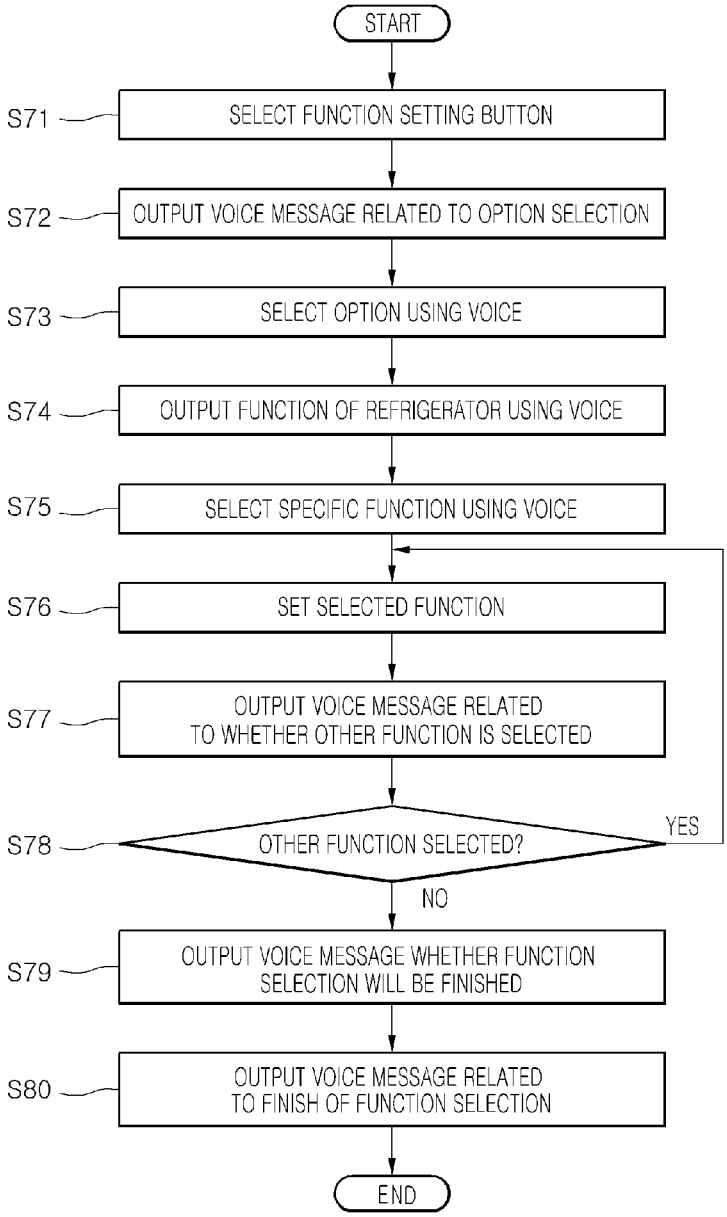
FIG. 15 is a flowchart illustrating a method of controlling a refrigerator according to a fourth embodiment.

FIG. 15 is a flowchart illustrating a method of controlling a refrigerator according to a fourth embodiment.

Referring to FIG. 15, when the function setting button 426 is selected (S71), the controller 430 transfers a voice signal on which option the user wants among the function setting, function change, and function identification to the voice output unit 439. Then, the voice output unit 439 outputs a voice on the option selection (S72). For example, the voice output unit 439 outputs a voice message 'select one function option among the function setting, function change, and function identification.'

In addition, when, for example, the 'function setting' option is input through the voice input unit 436 (S73), the controller 430 transfers the voice signal on the function setting to the voice output unit 439. Then, the voice output unit 439 outputs the voice message on the function setting. For example, the voice output unit 439 outputs a voice message 'set and identify the function of the refrigerator.'

Next, the controller 430 transfers the voice signal related to the refrigerating function to the voice output unit 439. Then, the voice output unit 439 outputs the voice signal related to the function of the refrigerator (S74). For example, the voice output unit 439 outputs a voice message 'select one of the temperature adjustment, special freezing, dispenser, additional functions.'

Further, for example, when the voice message 'special freezing function,' the converter 437 converts the voice message 'special freezing function' into a voice signal and transfers the voce signal to the controller 430. Then, the controller 430 compares the selected voice signal with a voice signal pre-stored in the memory 433 and set the special freezing function (S76). At this point, the voice output unit 439 outputs a voice message noting that the special freezing function is selected.

Next, the controller transfers a voice signal related where another function is selected to the voice output unit 439. Then, the voice output unit 439 outputs the voice message related to whether another function is selected (S77). For example, the voice output unit outputs a voice message 'select one of the temperature adjustment, dispenser, additional functions if you want to set another function.'

Next, the controller determines if another function is input from the voice input unit 436 (S78).

When the other function is selected by the voice, the controller 430 sets the selected another function (S76). Further, the controller 430 controls such that the voice message related to the other function selection is output from the voice output unit 439 (S77).

On the other hand, when a voice message 'no' rather than the other function selection is input from the voice input unit 436, the voice output unit 439 outputs a voice message related to where the function selection will be finished. For example, the voice output unit 439 outputs a voice message 'say 'finish' if you want to finish the function selection.'

When the voice message 'finish' is input through the voice input unit 436, the voice output unit 439 outputs a voice message 'the function setting is completed.'

According to the embodiment, since a variety of functions of the refrigerator can be set, changed, identified by the voice, the blind persons or elderly can easily set, change, and identify the function of the refrigerator. Since the function change of the refrigerator can be preformed through the same process as the above-embodiments, the detailed description thereof will be omitted herein.

Any reference in this specification to 'one embodiment,' 'an embodiment,' 'exemplary embodiment,' etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with others of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A method of controlling a refrigerator, the method comprising: inputting a voice command related to a specific function by a voice input unit; activating the specific function corresponding to the input voice command;

outputting a first voice message having a related voice information corresponding to the input voice command after activating the specific function;

inputting a corresponding voice information related to the first voice message by the voice input unit;

recognizing the inputted corresponding voice information;

outputting a second voice message having an identification voice information, the identification voice information being result information from an analysis of the recognized corresponding voice information;

inputting a confirmation voice information related to the second voice message by the voice input unit;

outputting a third voice message related to a storage chamber location;

inputting a storage chamber location voice information having the storage chamber location to select one of a plurality of storage chambers;

inputting a storage mode voice information having a storage mode corresponding to the selected storage chamber of the plurality of storage chambers;

determining whether the storage mode voice information is inputted; and outputting a fourth voice message related to a completion of the specific function when it is determined that the storage mode voice information is inputted.

* * * * *